US008770686B2

(12) United States Patent
Komaba et al.

(10) Patent No.: US 8,770,686 B2
(45) Date of Patent: Jul. 8, 2014

(54) IMAGE FORMING APPARATUS

(75) Inventors: Hiroyoshi Komaba, Kanagawa (JP); Shinji Imoto, Tokyo (JP); Satoshi Kitaoka, Kanagawa (JP); Seiji Hoshino, Kanagawa (JP); Shozo Sakura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 163 days.

(21) Appl. No.: 13/424,541

(22) Filed: Mar. 20, 2012

(65) Prior Publication Data

US 2012/0249627 A1 Oct. 4, 2012

(30) Foreign Application Priority Data

Mar. 30, 2011 (JP) ..... 2011-076166
Feb. 20, 2012 (JP) ..... 2012-033958

(51) Int. Cl.
*B41J 29/38* (2006.01)
*B41J 2/195* (2006.01)

(52) U.S. Cl.
USPC ..... 347/6; 347/7

(58) Field of Classification Search
None
See application file for complete search history.

(56) References Cited

U.S. PATENT DOCUMENTS 6,379,463 B1 * 4/2002 Kelley et al. ..... 118/666
8,127,709 B2 3/2012 Matsumoto et al.
2007/0019045 A1 * 1/2007 Umeda ..... 347/84
2010/0079516 A1 * 4/2010 Nakazawa ..... 347/7
2011/0220017 A1 9/2011 Kitaoka et al.
2011/0242157 A1 * 10/2011 Snyder et al. ..... 347/7
2011/0310185 A1 12/2011 Komaba et al.
2012/0060754 A1 3/2012 Kitaoka et al.

FOREIGN PATENT DOCUMENTS

JP 10-230201 9/1998
JP 2002-96454 4/2002
JP 2002-137378 5/2002
JP 2003-205673 7/2003
JP 2005-138502 6/2005
JP 2008-168283 7/2008
JP 2009-12394 1/2009

* cited by examiner

*Primary Examiner* — Matthew Luu
*Assistant Examiner* — Tracey McMillion
(74) *Attorney, Agent, or Firm* — Cooper & Dunham LLP

(57) ABSTRACT

An image forming apparatus including an image forming device forming an image on a surface of a recording material; a recording material passage; a treatment liquid applicator including a tray containing a treatment liquid, a first roller applying the treatment liquid to the surface of the recording material, and a second roller drawing the treatment liquid from the tray to supply the treatment liquid to the first roller; a liquid level inclination detector detecting whether the surface of the treatment liquid is inclined; a treatment liquid supplying device supplying the treatment liquid to the tray; and a controller connected with liquid level detector and the treatment liquid supplying device. The controller stops the operation of the treatment liquid supplying device when determining according to the detection result of the liquid level detector that the surface of the treatment liquid is inclined in a predetermined amount or more.

8 Claims, 8 Drawing Sheets

IMAGE FORMING APPARATUS

CROSS-REFERENCE TO RELATED APPLICATIONS

This patent application is based on and claims priority pursuant to 35 U.S.C. §119 to Japanese Patent Applications Nos. 2011-076166 and 2012-033958, filed on Mar. 30, 2011 and Feb. 20, 2012, respectively, in the Japan Patent Office, the entire disclosure of which is hereby incorporated herein by reference.

TECHNICAL FIELD

This disclosure relates to an image forming apparatus, and particularly to an image forming apparatus applying a treatment liquid on a recording material before or after forming an image on the recording material.

BACKGROUND

Image forming apparatuses having a recording head to eject droplets such as ink droplets have been used for printers, facsimiles, copiers, and multifunctional machines having a combination of these functions, and specific examples thereof include inkjet recording apparatuses.

Such inkjet recording apparatuses record images by ejecting droplets such as ink droplets from a recording head toward a recording material such as paper sheets, overhead projection (OHP) sheets, and other materials to which an ink can be adhered, to form an ink image on the recording material. Inkjet recording apparatuses are broadly classified into serial inkjet recording apparatuses in which a recording head ejects droplets while moving in a main scanning direction to form an image on a recording material, which is fed in a sub-scanning direction, and line inkjet recording apparatuses which have a fixed line recording head to eject droplets on a recording material fed in a direction perpendicular to the extending direction of the line recording head.

In this application, image forming apparatuses mean apparatuses which eject droplets to adhere the droplets to a recording material such as paper, yarn, fiber, fabric, leather, metal, plastic, glass, wood, and ceramic, thereby forming an image thereon. In addition, image formation means not only formation of a meaningful image such as letters and figures but also formation of a meaningless image such as patterns (i.e., mere adhesion of droplets on a recording material).

Further, ink means not only so-called inks but also other liquids, which can be used for image formation, such as recording liquids, liquid resins, fixing liquids, chemicals and the like liquids.

As mentioned above, the recording material for use in the image forming apparatus of this disclosure is not limited to paper, and other materials to which an ink can be adhered can also be used. In this regard, the recording material is a generic name of a receiving medium, a recording medium, and a recording paper.

In a case in which the liquid-ejecting image forming apparatus is a facility-type inkjet recording apparatus used for recording images in a field such as bookmaking and commercial printing, the inkjet recording apparatus typically has multiple inkjet recording heads, which are thermal inkjet recording heads or piezoelectric inkjet recording heads and each of which is fixedly set so as to extend in a direction perpendicular to the feeding direction of a recording material (without using a carriage), so that images can be formed on the recording material at a high speed only by feeding the recording material.

The inkjet recording apparatus of this kind can produce images at a high speed with low noise. In addition, images can be formed on various kinds of recording materials, and color images can be formed. Therefore, inkjet recording apparatus become widespread.

When a recording material is a fibrous material such as paper, a feathering problem in that a recording ink adhered to the recording material is irregularly penetrated along the fibers of the recording material, thereby forming an image whose outline has feathering, a color bleeding problem in that two adjacent color ink images have an unclear boundary due to mixing of the color inks, a low image density problem, a set off problem in that an ink image is transferred onto a backside of another recording material sheet, an insufficient glossiness problem in that an image having insufficient glossiness is formed, and a fixing problem in that an image having insufficient fixability is formed, can be caused.

In addition, other problems such as primary image quality problems (e.g., a slow drying problem in that a recorded image has a long drying time), and poor image resistance problems (e.g., problems in that resistance of images to water, light, abrasion and ozone is poor) can be caused.

In order to avoid the above-mentioned problems, there are proposals in that a treatment liquid, which can be reacted with the ink used for image formation, is applied to or sprayed on a recording material before or after the image formation operation. In this regard, specific examples of the reaction include absorption of a colorant in the ink, aggregation of a colorant, or the like.

In addition, there is a proposal in that a foamed treatment liquid is applied on a recording material before or after the image formation operation.

With respect to the treatment liquid applicator for use in such image forming apparatus, there is a proposal in that in order to maintain the level of a treatment liquid in a liquid container of the applicator, a ball valve is provided between the treatment liquid and the liquid supplying opening to control the level (i.e., volume) of the treatment liquid in the container by properly stopping supply of the liquid.

FIG. 11 is a schematic view illustrating a conventional applicator equipped with a treatment liquid supplying device. Referring to FIG. 1, an applicator 200 has a treatment liquid container 303, a tray 206 containing a treatment liquid 201 to be applied to a recording material, and a liquid flow path 302 connected with the container 303 and an upper portion of the tray 206 to feed the treatment liquid 201 from the container 303 to the tray 206. The end portion of the liquid flow path 302 facing the tray 206 has a venturi-type opening in which a liquid-level adjusting ball valve 301 having a hollow float is provided. The ball valve 301 is moved up and down depending on the level of the surface of the treatment liquid in the tray 206, and has a structure such that when the level of the surface of the treatment liquid reaches a predetermined highest level, the opening is closed, thereby stopping supply of the treatment liquid from the container 303 to the tray 206. In FIG. 11, reference numeral 233 denotes a squeeze roller to pick up the treatment liquid 201.

FIG. 12 illustrates the applicator illustrated in FIG. 11, which is inclined. In this case, a left side edge of the squeeze roller 233 in the axis direction thereof is not contacted with the treatment liquid 201 while a right side edge of the squeeze roller is contacted with the treatment liquid, thereby causing an insufficient liquid supply problem in that the treatment liquid 201 is not applied on the left side of a recording material.

FIG. 13 illustrates the applicator illustrated in FIG. 11, which is inclined but is in another state different from the state of the applicator illustrated in FIG. 12. Specifically, in FIG. 13, since the ball valve 301 has an open state because the level of the surface of the treatment liquid 201 is low, the treatment liquid is supplied to the tray 206 from the container 302. In this case, since the applicator 200 (i.e., the tray 206) is inclined, an overflow problem in that the treatment liquid 201 overflows from the right side wall of the tray 206 as illustrated by an arrow in FIG. 13 occurs.

For these reasons, the inventors recognized that there is a need for an image forming apparatus which has a treatment liquid applicator and which can satisfactorily apply a treatment liquid on a recording material without causing the insufficient liquid supply problem and the overflow problem mentioned above.

SUMMARY

As an aspect of this disclosure, an image forming apparatus is provided which includes an image forming device to form an image on a surface of a recording material; a recording material passage; a treatment liquid applicator, which includes at least a tray to contain a treatment liquid, a first roller (applicator roller) opposed to the recording material passage to apply the treatment liquid to the surface of the recording material, and a second roller (squeeze roller) adjacent to the first roller to pick up the treatment liquid from the tray to supply the treatment liquid to the first roller; a liquid level inclination detector to detect whether the surface of the treatment liquid in the tray is inclined; a treatment liquid supplying device to supply the treatment liquid to the tray; and a controller having an input terminal connected with liquid level inclination detector and an output terminal connected with the treatment liquid supplying device. The controller stops the operation of the treatment liquid supplying device when the liquid level inclination detector detects that the surface of the treatment liquid in the tray is inclined in a predetermined amount or more.

The aforementioned and other aspects, features and advantages will become apparent upon consideration of the following description of the preferred embodiments taken in conjunction with the accompanying drawings.

DETAILED DESCRIPTION

The image forming apparatus of this disclosure will be described by reference to several examples.

Figure 1:
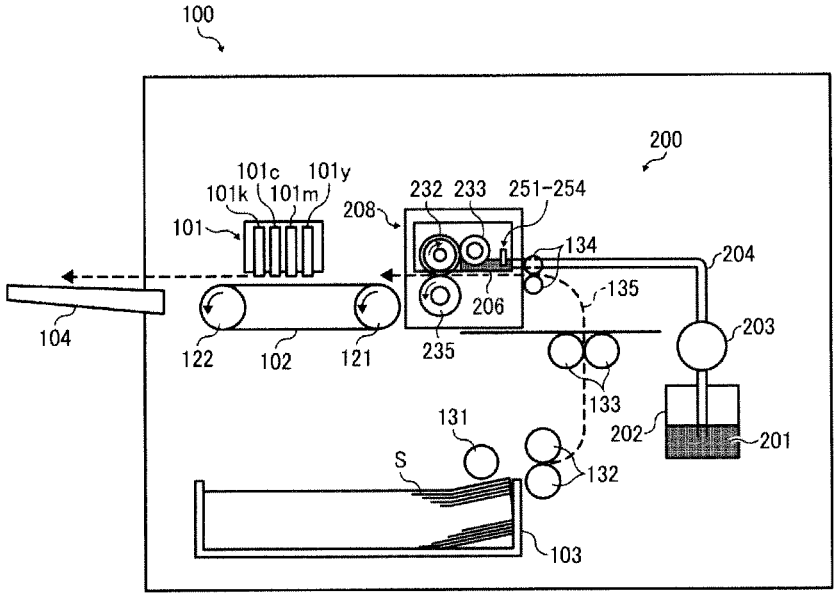
FIG. 1 is a schematic view illustrating an example of the image forming apparatus of this disclosure.

FIG. 1 is a schematic view illustrating an inkjet recording apparatus as an example of the image forming apparatus of this disclosure. Specifically, an inkjet recording apparatus 100 ejects droplets toward a recording material sheet S to form an image on the recording material.

The inkjet recording apparatus 100 includes a recording head unit 101 serving as an image forming device, a feeding belt 102 to feed the recording material sheet S, a recording material tray 103 to accommodate the recording material sheet S, a copy tray 104 on which the recording material sheet S bearing an image thereon is stacked, and a treatment liquid applicator 200 to apply a treatment liquid to a surface of the recording material sheet S on an upstream side from the recording head unit 101 relative to the recording material feeding direction.

The recording head unit 101 includes a line recording head in which multiple inkjet nozzles are arranged in a direction perpendicular to the recording material feeding direction so as to face the recording material sheet S to form a color image on the recording material sheet S without being moved in the direction (i.e., main scanning direction). The multiple nozzles include lines of nozzles 101*y*, 101*m*, 101*c* and 101*k* to respectively eject yellow (Y), magenta (M), cyan (C) and black (K) inks toward the recording material sheet S.

The recording head unit 101 is not limited to a line recording head, and a serial recording head, which is set on a carriage so as to be moved in the main scanning direction perpendicular to the recording material feeding direction, can also be used.

The feeding belt 102 is an endless belt, and is looped around a feeding roller 121 and a tension roller 122 so as to be rotated by the feeding roller 121. In this regard, the method by which the recording material sheet S is attracted to the feeding belt 102 to be fed in the recording material feeding direction is not particularly limited, and methods such as attraction methods using an electrostatic force or air suction can be used.

The recording material sheets S set on the recording material tray 103 are supplied by a pickup roller 131 one by one while separated from each other, and the thus supplied recording material sheet S is fed by a pair of feeding rollers 132. The recording material sheet S is further fed by pairs of feeding rollers 133 and 134 through a passage 135 serving as a recording material passage so that a surface of the recording material sheet S is coated with a treatment liquid by the treatment liquid applicator 200. After the treatment liquid application operation, the recording material sheet S is fed so as to be born by the feeding belt 102. The recording material sheet S is then fed by the feeding belt 102, and the recording head unit 101 ejects droplets of the color inks toward the recording material sheet S to form a color image on the treated surface of the recording material sheet S. The recording material sheet S bearing the color image thereon is then discharged from the main body of the image forming apparatus 100 to be stacked on the copy tray 104.

The treatment liquid applicator 200 includes a container 202 to contain a treatment liquid 201, a pump 203 serving as a treatment liquid supplying device (or a liquid feeder) to perform pressure feeding on the treatment liquid and to collect the treatment liquid from the tray 206 through a liquid flow path 204, and a coater 208 to coat the recording material sheet S with the treatment liquid 201. The pump 203 is driven in a forward direction when feeding the treatment liquid 201 to the coater 208, while driven in a reverse direction when collecting the treatment liquid 201 from the tray 206. Alternatively, a bypass of the liquid flow path 204, through which the treatment liquid 201 flows naturally by gravitation from the tray 206 to the container 202 by opening an on-off valve, may be provided instead of reversely driving the pump 203.

The treatment liquid 201 in the container 202 is pumped up by the pump 203 to be supplied to the tray 206 through the liquid flow path 204, which is connected with a bottom portion of the tray 206. The treatment liquid 201 in the tray 206 is drawn by a squeeze roller 233, part of which is dipped in the treatment liquid 201, to be supplied to a coating roller 232, and the treatment liquid supplied to the coating roller 232 is applied to the surface of the recording material sheet S.

The treatment liquid 201 is a surface modifier to modify the surface of the recording material S. For example, by evenly applying the treatment liquid 201 on the entire surface of the recording material, the following effect can be produced. Specifically, water included in the ink droplets (i.e., ink image) adhered to the modified surface of a recording paper serving as the recording material rapidly penetrates thereinto while increasing the viscosity of the colorant component in the ink image. Therefore, the ink image can be rapidly dried, and occurrence of the feathering problem, the color bleeding problem, and an ink penetration problem in that the ink adhered to a surface of the recording material penetrates to the backside of the recording material is prevented while increasing the copying speed (i.e., the number of copies per a unit time). Thus, the treatment liquid serves as a fixing agent or a setting agent. As mentioned above, the recording material S is not limited to paper.

Specific examples of the treatment liquid 201 include liquids including a surfactant (e.g., anionic surfactants, cationic surfactants, nonionic surfactants, and combinations thereof), a cellulose compound (e.g., hydroxypropyl cellulose), and a base material such as particulate talc. In addition, the liquids can optionally include other particulate materials.

The image forming apparatus of this disclosure is characterized in that supply of the treatment liquid and the amount of the treatment liquid in the tray 206 are controlled based on the inclination condition of the tray 206 to prevent occurrence of problems such that the treatment liquid in the tray overflows, or the treatment liquid is not supplied to the squeeze roller and thereby the treatment liquid cannot be satisfactorily applied to the recording material. In FIG. 1, reference numeral 235 denotes a backup roller.

Figure 2:
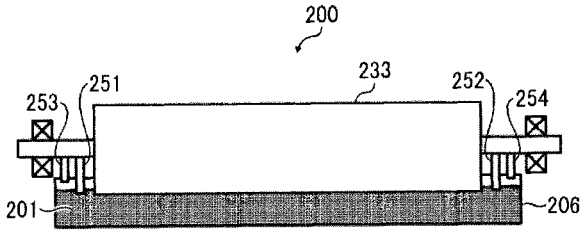
FIG. 2 is a schematic view illustrating a treatment liquid applicator for use in the image forming apparatus of this disclosure.

FIG. 2 is a schematic view illustrating the treatment liquid applicator 200 of the image forming apparatus illustrated in FIG. 1.

In the treatment liquid applicator 200, the squeeze roller 233 draws the treatment liquid 201 from the tray 206. The squeeze roller 233 is positioned so that a lower portion of the squeeze roller 233 is dipped in the treatment liquid 201 in the tray 206 in a predetermined depth. In addition, liquid level inclination detectors 251 and 252 to detect whether the surface of the treatment liquid is inclined are provided in the vicinity of both ends of the squeeze roller 233 in the axial direction thereof.

The liquid level inclination detectors 251 and 252 also serve as liquid level detectors (i.e., a stored liquid amount detector), which detect the level of the treatment liquid 201 to determine whether the treatment liquid 201 is sufficiently contained in the tray 206 and which output a detection signal when being contacted with the treatment liquid 201.

As illustrated in FIG. 2, sensors (liquid level sensors) of the liquid level inclination detectors 251 and 252 are arranged at such positions as to face both the ends of the lower portion of the squeeze roller 233 in the axial direction thereof and to be slightly higher in level that the lowest surface of the squeeze roller 233, so that the sensors are contacted with the treatment liquid while the lower portion of the squeeze roller 233 is dipped in the treatment liquid 201. In addition, the liquid level inclination detectors 251 and 252 are connected to an input terminal of a controller 1000 mentioned below so that the controller 1000 can determine whether the treatment liquid 201 is sufficiently contained in the tray 206 in the axial direction of the squeeze roller 233 based on contact of the liquid level inclination detectors 251 and 252 with the treatment liquid 201.

In addition, second liquid level inclination detectors 253 and 254 are arranged outside the liquid level inclination detectors 251 and 252 so as to face the liquid level inclination detectors 251 and 252, respectively. Namely, a pair of detectors (sensors) 251 and 253 is set on one side of the squeeze roller 233 and another pair of detectors (sensors) 252 and 254 is set on the other side of the squeeze roller 233. As illustrated in FIG. 2, the lower surfaces (i.e., liquid level sensors) of the second liquid level inclination detectors 253 and 254 are higher in level than those of the liquid level inclination detectors 251 and 252. The sensors of the second liquid level inclination detectors 253 and 254 are arranged at positions such that the surface of the treatment liquid 201 can be detected shortly before the treatment liquid overflows from one side of the tray 206 when the tray 206 is inclined (i.e., the sensors of the second liquid level inclination detectors 253 and 254 are arranged so as to be lower than the upper end of the side wall of the tray 206).

Figure 3:
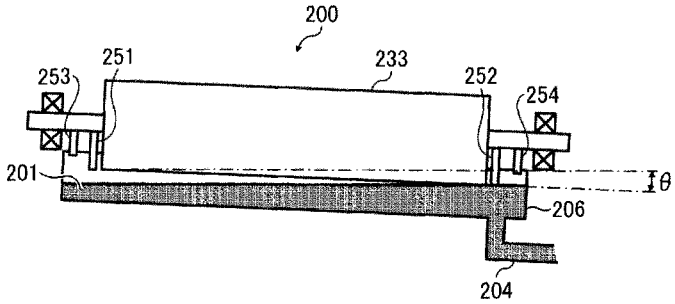
FIG. 3 is a schematic view illustrating the treatment liquid applicator illustrated in FIG. 2, which is inclined for the purpose of illustration.

In this example, the liquid level inclination detectors 251 and 252 and the second liquid level inclination detectors 253 and 254 are arranged at positions such that when the tray 206 is inclined at a predetermined angle of (θ) as illustrated in FIG. 3, the inclination of the surface of the treatment liquid can be detected by a combination of the detectors 251 and 253 or a combination of the detectors 252 and 254, and therefore overflowing of the treatment liquid 201 from a lower side wall (i.e., the right side wall in FIG. 3) of the tray 206 can be prevented.

Figure 4:
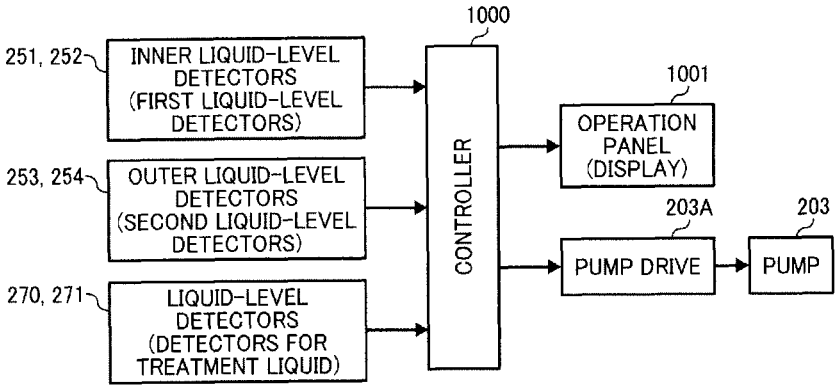
FIG. 4 is a block diagram illustrating a controller for use in the image forming apparatus illustrated in FIG. 1.

FIG. 4 illustrates the structure of the controller 1000 which is connected with the liquid level inclination detectors 251 and 252 and the second liquid level inclination detectors 253 and 254 at an input terminal thereof.

Referring to FIG. 4, the controller 1000, which is a process controller in this example, is connected with the liquid level inclination detectors 251 and 252 and the second liquid level inclination detectors 253 and 254 at an input terminal thereof. In addition, the controller 1000 is connected with a pump drive 203A for driving the pump 203, and an operation panel (display) 1001 which serves as an operating portion and which can display or issue a warning.

In the present application, the inclination detector to detect inclination of the surface of the treatment liquid is not limited to the detectors 251-254, and angle sensors capable of detecting angle change using a level, acceleration sensors capable of detecting change of velocity per one second, and angular velocity sensors capable of detecting the number of rotation per one second can also be used therefor.

The controller 1000 performs control such that when the controller determines from the information from the first and second liquid level inclination detectors 251-254 that the surface of the treatment liquid 201 is inclined at the predetermined angle and the treatment liquid is about to overflow from the tray 206, the controller stops the pump 203, thereby stopping supply of the treatment liquid 201 from the container 202 while stopping the coating operation of the coater 208.

Figure 5:
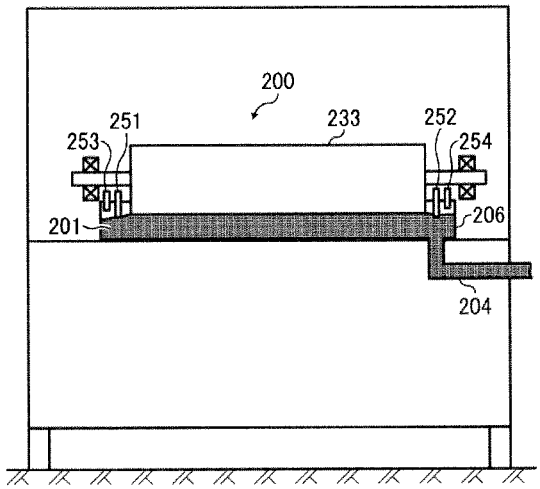
FIGS. 5 and 6 are schematic views for explaining an example of the control operation of the controller illustrated in FIG. 4.

FIG. 5 is a schematic view for explaining an example of the control operation of the controller. When the treatment liquid 201 is fed (pressure feeding) to the tray 206 from the container 202 by the pump 203, the liquid feeding operation is performed until the surface of the treatment liquid 201 in the tray 206 is detected by both of the liquid level inclination detectors 251 and 252. In this regard, when the surface of the treatment liquid 201 is inclined, the surface is detected by one of the liquid level inclination detectors 251 and 252. In this case, the treatment liquid 201 is further fed to the tray 206 until the surface of the treatment liquid 201 is detected by both of the liquid level inclination detectors 251 and 252.

Thus, the treatment liquid 201 is fed to the tray 206 until the surface of the treatment liquid is detected by both of the liquid level inclination detectors 251 and 252. Therefore, the entire surface of a lower portion of the squeeze roller 233 in the axial direction thereof can be contacted with the treatment liquid 201, i.e., the treatment liquid can be satisfactorily supplied to the squeeze roller 233, thereby preventing occurrence of the insufficient liquid supply problem. Thus, the combination of the liquid level inclination detectors 251 and 252 serves as a stored liquid amount detector.

Figure 6:
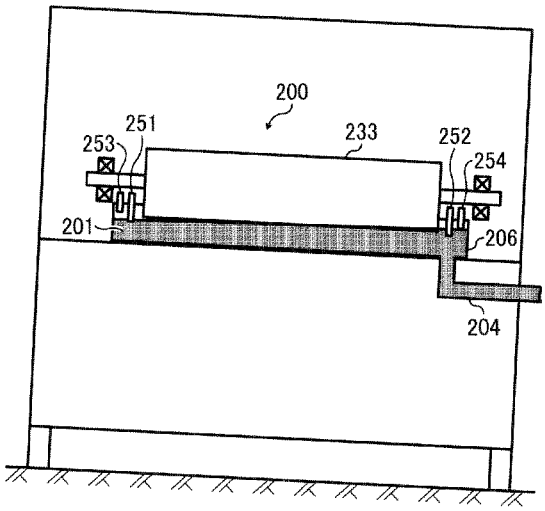

FIG. 6 illustrates the treatment liquid applicator 200, which is inclined at the predetermined angle and in which the treatment liquid 201 is fed to the tray 206 such that the surface of the treatment liquid is detected by both the liquid level inclination detectors 251 and 252. In this case, the surface of the treatment liquid 201 is also detected by the detector 254 on the right side (i.e., lower side) of the tray 206 as illustrated in FIG. 6. As a result, the controller 1000 stops the pump 203 while collecting the treatment liquid 201 from the tray 206 and displaying a warning message in the operation panel 1001 such that the treatment liquid is in an overflowing state (i.e., the tray 206 or the image forming apparatus 100 is abnormally inclined).

Upon receipt of the warning, the user changes the setting condition of the image forming apparatus 100 so that the tray 206 is set horizontally, and therefore occurrence of the overflow problem can be prevented, thereby preventing the parts in the vicinity of the tray 206 from being damaged by the overflowing treatment liquid.

Figure 7:
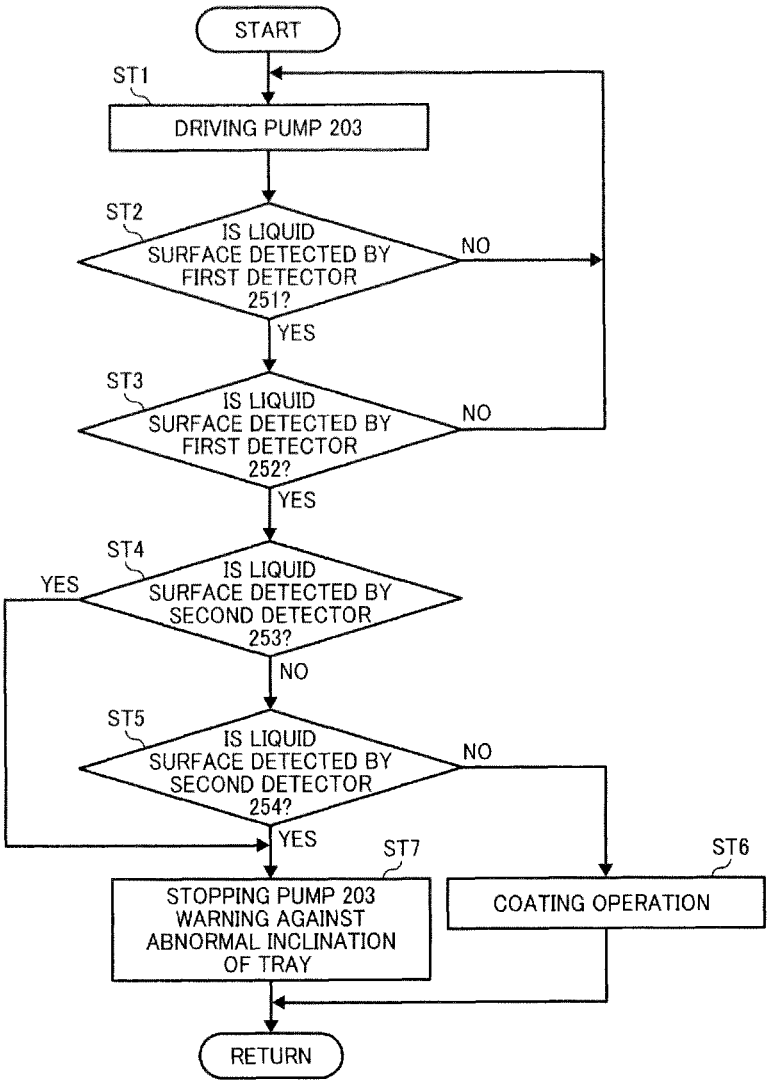
FIG. 7 is a flowchart illustrating the control operation of the controller.

FIG. 7 is a flowchart illustrating the operation of the controller 1000.

When the image forming apparatus 100 is operated, supply of the treatment liquid is started. Specifically, the pump 203 is driven (step ST1) to feed the treatment liquid 201 in the container 202 to the tray 206.

Next, the level of the surface of the treatment liquid is detected by the liquid level inclination detectors (i.e., first liquid level inclination detectors) 251 and 252 (steps ST2 and ST3). When the surface of the treatment liquid 201 is detected by both the liquid level inclination detectors 251 and 252 and the surface is not detected by any one of the second liquid level inclination detectors 253 and 254 (NO in steps ST4 and ST5), it is judged that the tray 206 is not inclined (as illustrated in FIG. 5), and the coating operation starts to be performed (step ST6). If the surface of the treatment liquid is not detected in a predetermined time in step ST2 and ST3, the following operations may be performed although it is not described in FIG. 7. Specifically, in such a case, it is judged whether the detection operation is performed for a predetermined period of time. If it is judged that the detection operation is performed for the predetermined time, it is judged whether the pump 203 is not satisfactorily operated or the treatment liquid is exhausted, and then a warning is issued in the operation panel 1001 such that the pump 203 is not satisfactorily operated or the treatment liquid is exhausted based on the judgment results.

In contrast, when the surface of the treatment liquid 201 is detected by one of the second liquid level inclination detectors 253 and 254 in step ST4 or ST5 (i.e., YES in step ST4 or ST5) after the steps ST1 and ST2, an ON signal is output from the second liquid level inclination detector 253 or 254, which is contacted with the treatment liquid 201. In this case, it is judged that the side of the tray 206, on which both of the first liquid level inclination detector (251 or 252) and the second liquid level inclination detector (253 or 254) detect the liquid surface (i.e., on which a combination of the detectors 251 and 253 or a combination of the detectors 252 and 254 detects the surface of the treatment liquid), is the lower side, and the treatment liquid 201 is about to overflow from the side of the tray 206. Therefore, the controller 1000 stops the pump 203 while issuing a warning in the operation panel 1001 such that the treatment liquid is in an overflowing state (i.e., the tray or the image forming apparatus is abnormally inclined) (step ST7).

As mentioned above, by merely providing liquid level detectors, the detectors can be used as liquid level inclination detectors, and occurrence of the insufficient supply problem and the overflow problem can be prevented without complicating the configuration of the treatment liquid applicator.

Next, another example of the image forming apparatus will be described.

The feature of this example is that when the treatment liquid 201 is about to overflow due to inclination of the tray 206, the treatment liquid 201 is collected.

Figure 8:
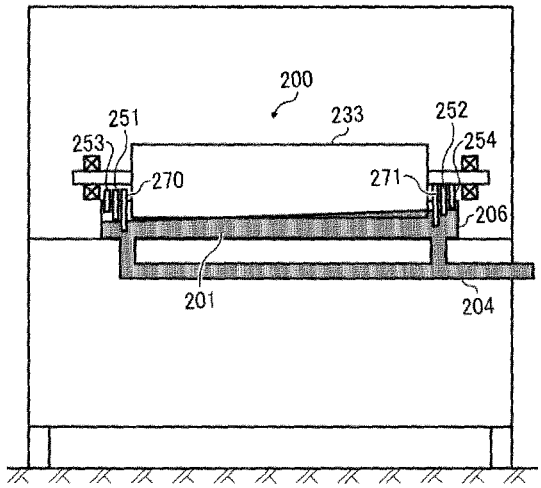
FIG. 8 is a schematic view illustrating another treatment liquid applicator, which is for use in the image forming apparatus of this disclosure and which is inclined for the purpose of illustration.

FIG. 8 illustrates the treatment liquid applicator 200 of the image forming apparatus of this example, in which the tray 206 is relatively inclined compared to the tray illustrated in FIG. 6. In the treatment liquid applicator 200 illustrated in FIG. 8, the liquid flow path 204 is connected with communicating portions located on both the end portions of the bottom of the tray 206 in the axial direction of the squeeze roller 233.

In addition, liquid level detectors 270 and 271 (hereinafter sometimes referred to as third liquid level detectors) other than the first and second liquid level inclination detectors 251-254 are provided so as to face the communicating portions of the tray 206 with the liquid flow path 204. The third liquid level detectors 270 and 271 are connected with the input terminal of the controller 1000. When each of the third liquid level detectors 270 and 271 is contacted with the treatment liquid, a detection signal is output to the controller 1000.

In this example, the controller 1000 determines whether the tray 206 is inclined and performs the pump control operation mentioned above by reference to FIGS. 4-7 when determining that the tray 206 is inclined. In addition, when the tray 206 is inclined at the predetermined angle, the controller 1000 performs another control operation such that the pump 203 is reversely rotated (i.e., rotated in a direction opposite to that in a case where the pump feeds the treatment liquid 201 to the tray 206) or the treatment liquid 201 in the tray 206 is allowed to flow through the liquid flow path 204 by gravitation by opening the liquid flow path 204, for example, by opening an on-off valve attached to the pump 203. In this example, the pump 203 serves as a liquid feeder to feed the treatment liquid 201 to the tray 206 and to collect the treatment liquid 201 from the tray through the liquid flow path 204.

Figure 9:
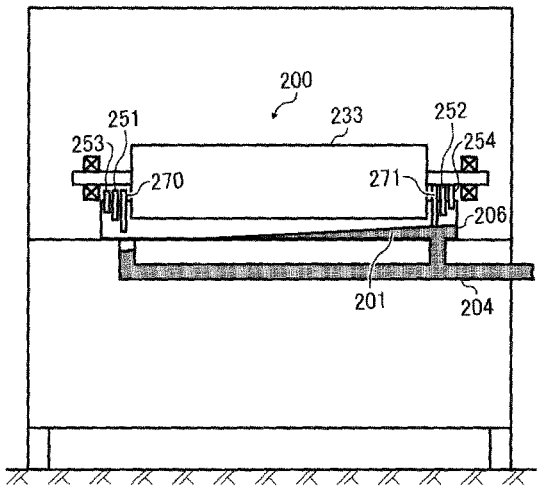
FIG. 9 a schematic view for explaining a control operation of the controller illustrated in FIG. 4 to be performed on the treatment liquid applicator illustrated in FIG. 8.

FIG. 9 illustrates the treatment liquid applicator 200 in which the treatment liquid 201 in the tray 206 has been collected. In this case, whether or not the treatment liquid 201 in the tray 206 has been collected is determined by checking whether the condition of contact of at least one of the third liquid level detectors 270 and 271 with the treatment liquid 201 is changed. Specifically, when the controller 1000 determines that the treatment liquid 201 in the tray 206 has been collected by checking the condition of contact of the third liquid level detectors 270 and 271, the controller 1000 stops the pump 203 or closes the on-off valve. More specifically, in FIG. 9, the liquid level detector 270 is separated from the surface of the treatment liquid 201, and therefore the controller 1000 determines that the condition of contact of at least one of the third liquid level detectors 270 and 271 with the treatment liquid is changed.

Figure 10:
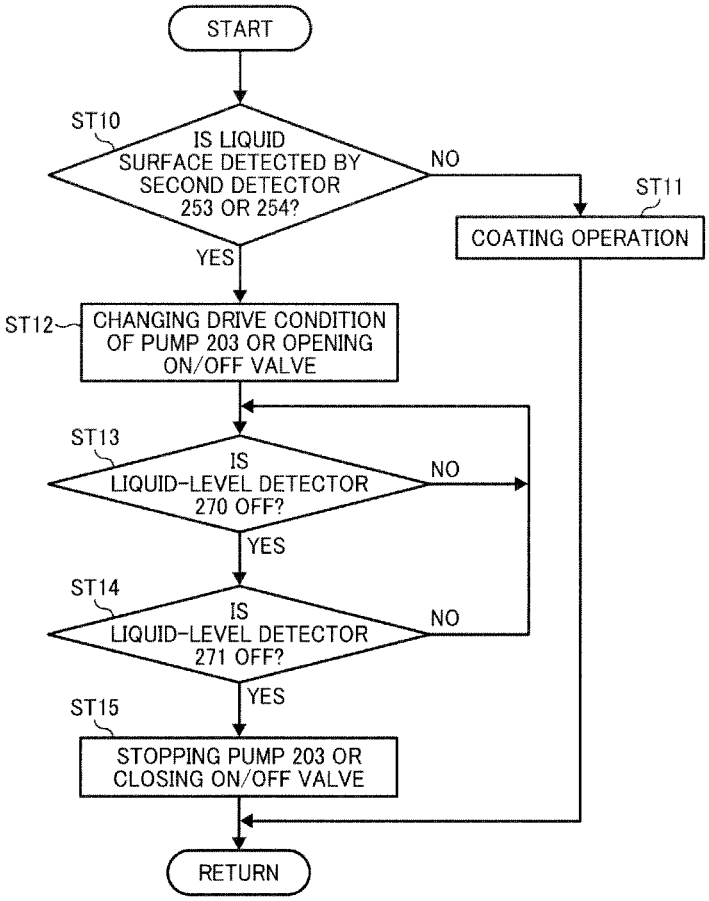
FIG. 10 is a flowchart illustrating a control operation of the controller to be performed on the treatment liquid applicator illustrated in FIG. 8.
Figure 11:
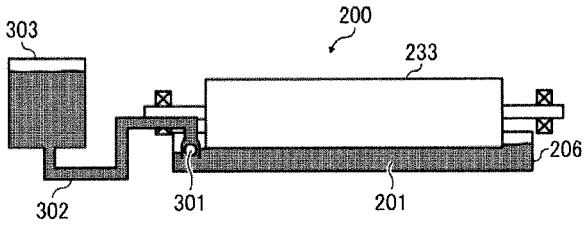
FIG. 11 RELATED ART
FIG. 11 is a schematic view illustrating a conventional treatment liquid applicator.
Figure 12:
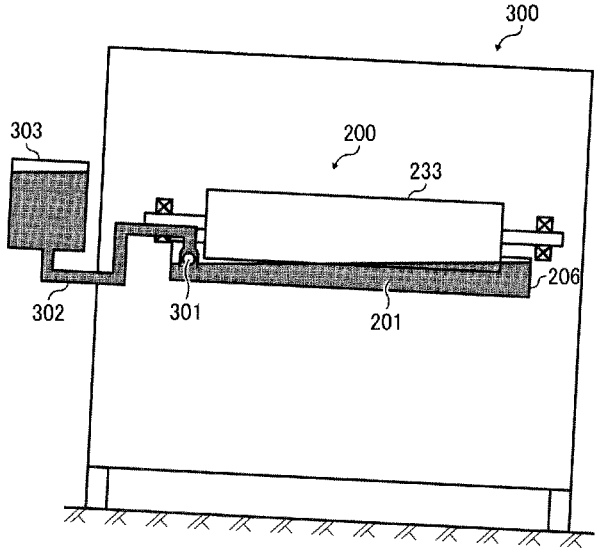
FIG. 12 RELATED ART
FIGS. 12 and 13 are schematic views for explaining problems caused when the conventional treatment liquid applicator is inclined.
Figure 13:
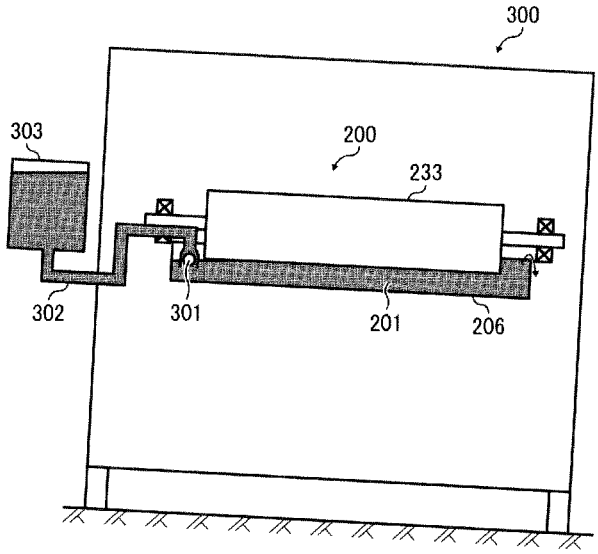
FIG. 13 RELATED ART

FIG. 10 is a flowchart illustrating the control operation of the controller 1000 in this example of the image forming apparatus, which has the treatment liquid applicator illustrated in FIG. 8.

FIG. 10 illustrates processes of the control operation starting from the liquid level detection process performed by the second liquid level inclination detectors 253 and 254.

In FIG. 10, when the controller determines that the surface of the treatment liquid 201 is detected by any one of the second liquid level inclination detectors 253 and 254 (i.e., the signal is received from one of the second liquid level detectors) (YES in step ST10), the controller 1000 stops the pump 203, and reversely rotates the pump 203, or opens the on-off valve (step ST12). When the liquid surface is not detected (No in step ST10), it is judged that the tray 206 is not inclined, and the coating operation is performed (step ST11).

When the liquid surface is detected (Yes in step ST10), it is judged that the tray 206 is inclined, and the treatment liquid 201 is allowed to flow to the liquid flow path 204 from the tray 206 by reversely rotating the pump 203 or opening the on-off valve until the surface of the treatment liquid 201 is not detected by the third liquid level detectors 270 and 271 (i.e., both the third liquid level detectors 270 and 271 are in an OFF state) (steps ST13 and ST14). When it is judged that the treatment liquid 201 in the tray 206 is collected and occurrence of the overflow problem is prevented based on the results of the judgment processes in steps ST13 and ST14, the controller 1000 stops the pump 203 or closes the on-off valve (step ST15). When both the third liquid level detectors 270 and 271 are in an OFF state in the control operation illustrated in FIG. 10, the pump 203 is stopped. However, it is possible to stop the pump 203 when any one of the third liquid level detectors 270 and 271 are in an OFF state. In this case, it is preferable to watch the first or second liquid level inclination detector 251 or 253 (or 252 or 254) in the vicinity of the one of the third liquid level detector 270 or 271 detecting the surface of the treatment liquid in order that occurrence of the overflow problem is securely prevented.

In this example, the liquid flow path 204 is connected with the bottom of the tray 206, and therefore the treatment liquid 201 can flow through the liquid flow path 204 by gravitation in the liquid collection process. Therefore, occurrence of the overflow problem can be securely prevented without complicating the structure of the treatment liquid applicator.

Additional modifications and variations of this disclosure are possible in light of the above teachings. It is therefore to be understood that within the scope of the appended claims the invention may be practiced other than as specifically described herein.

What is claimed is:

1. An image forming apparatus comprising:

an image forming device to form an image on a surface of a recording material;

a recording material passage through which the recording material is fed;

a treatment liquid applicator including:

a tray to contain treatment liquid;

a first roller opposed to the recording material passage to apply the treatment liquid to the recording material fed through the recording material passage; and a second roller adjacent to the first roller to pick up the treatment liquid from the tray to supply the treatment liquid to the first roller;

a liquid level inclination detector to detect whether a surface of the treatment liquid in the tray is inclined;

a treatment liquid supplying device to supply the treatment liquid to the tray; and a controller connected with the liquid level inclination detector and the treatment liquid supplying device, wherein the controller stops the treatment liquid supplying device from supplying the treatment liquid when determining according to a detection result of the liquid level inclination detector that the surface of the treatment liquid in the tray is inclined in a predetermined amount or more, wherein the liquid level inclination detector includes liquid level sensors disposed at respective ends of the second roller in an axial direction of the second roller.

2. The image forming apparatus according to claim 1, wherein the liquid level inclination detector detects inclination of the surface of the treatment liquid by angle, and wherein the controller stops the treatment liquid supplying device from supplying the treatment liquid when determining according to a detection result of the liquid level inclination detector that the surface of the treatment liquid in the tray is inclined at a predetermined angle, below which the treatment liquid in the tray does not overflow from the tray.

3. The image forming apparatus according to claim 1, wherein the liquid level sensors disposed at the respective ends of the second roller in the axial direction thereof constitute a first liquid level inclination detector and also serve as a stored liquid amount detector to detect an amount of the treatment liquid stored in the tray, and wherein the liquid level inclination detector further includes:

a second liquid level inclination detector having additional liquid level sensors disposed at the respective ends of the second roller in the axial direction thereof, wherein the additional liquid level sensors are located at a higher position, in a vertical direction, than the liquid level sensors that constitute the first liquid level inclination detector, and wherein the controller drives the treatment liquid supplying device until both of the liquid level sensors that constitute the first liquid level inclination detector detect the surface of the treatment liquid in the tray.

4. An image forming apparatus comprising:

an image forming device to form an image on a surface of a recording material;

a recording material passage through which the recording material is fed;

a treatment liquid applicator including:

a tray to contain the treatment liquid;

a first roller opposed to the recording material passage to apply the treatment liquid to the recording material fed through the recording material passage; and a second roller adjacent to the first roller to pick up the treatment liquid from the tray to supply the treatment liquid to the first roller;

a liquid level inclination detector to detect whether a surface of the treatment liquid in the tray is inclined;

a treatment liquid supplying device to supply the treatment liquid to the tray;

a controller connected with the liquid level inclination detector and the treatment liquid supplying device, wherein the controller stops the treatment liquid supplying device from supplying the treatment liquid when determining according to a detection result of the liquid level inclination detector that the surface of the treatment liquid in the tray is inclined in a predetermined amount or more; and an operating portion to issue a warning that the treatment quid is about to overflow, the operating portion being connected with the the controller, wherein the controller allows the operating portion to issue the warning when determining according to the detection result of the liquid level inclination detector that the surface of the treatment liquid in the tray is inclined in the predetermined amount or more.

5. The image forming apparatus according to claim 1, wherein the treatment liquid supplying device includes:

a liquid flow path, which is connected with a bottom portion of the tray and through which the treatment liquid is supplied to the tray by the treatment liquid supplying device.

6. The image forming apparatus according to claim 5, wherein the treatment liquid supplying device includes:

at least one of a liquid feeder capable of feeding the treatment liquid to the tray through the liquid flow path and collecting the treatment liquid from the tray through the liquid flow path, and an on-off valve capable of opening and closing the liquid flow path.

7. An image forming apparatus comprising:

an image forming device to form an image on a surface of a recording material;

a recording material passage through which the recording material is fed;

a treatment liquid applicator including:

a tray to contain the treatment liquid;

a first roller opposed to the recording material passage to apply the treatment liquid to the recording material fed through the recording material passage; and a second roller adjacent to the first roller to pick up the treatment liquid from the tray to supply the treatment liquid to the first roller;

a liquid level inclination detector to detect whether a surface of the treatment liquid in the tray is inclined;

a treatment liquid supplying device to supply the treatment liquid to the tray;

a controller connected with the liquid level inclination detector and the treatment liquid supplying device, wherein the controller stops the treatment liquid supplying device from supplying the treatment liquid when determining according to a detection result of the liquid level inclination detector that the surface of the treatment liquid in the tray is inclined in a predetermined amount or more; and a liquid level detector, which is different from the liquid level inclination detector and which includes a liquid level sensor located at each side of the second roller in an axial direction thereof to detect a level of surface of the treatment liquid in the tray, wherein the treatment liquid supplying device includes:

a liquid flow path, which is connected with two bottom portions of the tray and through which the treatment liquid is supplied to the tray or is collect from the tray according to a detection result of the liquid level detector, wherein the two bottom portions face the liquid level sensors, respectively; and at least one of a liquid feeder capable of feeding the treatment liquid to the tray through the liquid flow path and collecting the treatment liquid from the tray through the liquid flow path, and an on-off valve capable of opening and closing the liquid flow path, and wherein the controller controls an amount of the treatment liquid remaining in the tray according to a detection result of the second liquid level detector when the treatment liquid is collected.

8. The image forming apparatus according to claim 1, wherein a sensing position in a vertical direction of one of the liquid level sensors is different from a sensing position of the other liquid level sensor of the liquid level sensors.

* * * * *